United States Patent [19]

Rollmann

[11] 4,272,357

[45] Jun. 9, 1981

[54] DESULFURIZATION AND DEMETALATION OF HEAVY CHARGE STOCKS

[75] Inventor: Louis D. Rollmann, Princeton, N.J.

[73] Assignee: Mobil Oil Corporation, Fairfax, Va.

[21] Appl. No.: 93,317

[22] Filed: Nov. 13, 1979

Related U.S. Application Data

[63] Continuation of Ser. No. 671,906, Mar. 29, 1976, abandoned.

[51] Int. Cl.[3] ..... C10G 45/02; C10G 45/26

[52] U.S. Cl. ..... 208/89; 208/61; 208/210; 208/216 R; 208/251 H

[58] Field of Search ..... 208/213-216, 208/210, 58, 61, 89

[56] References Cited

U.S. PATENT DOCUMENTS

| | | | |
|---|---|---|---|
| 2,924,568 | 2/1960 | Anderson et al. | 208/216 |
| 3,112,257 | 11/1963 | Douwes et al. | 208/216 |
| 3,116,234 | 12/1963 | Douwes et al. | 208/216 |
| 3,472,759 | 10/1969 | Masologites et al. | 208/216 |
| 3,475,324 | 10/1969 | Borst | 208/213 |
| 3,489,674 | 1/1970 | Borst | 208/213 |
| 3,720,602 | 3/1973 | Riley et al. | 208/216 |
| 3,753,894 | 8/1973 | Shoemaker | 208/216 |
| 3,992,285 | 11/1976 | Hutchings | 208/213 X |
| 4,013,637 | 3/1977 | Eberly | 208/216 |
| 4,052,295 | 10/1977 | Pronk | 208/211 |

*Primary Examiner*—Delbert E. Gantz
*Assistant Examiner*—G. E. Schmitkons
*Attorney, Agent, or Firm*—C. A. Huggett; M. G. Gilman; E. J. Trojnar

[57] ABSTRACT

A process for the desulfurization and demetalation of a nickel and sulfur containing heavy hydrocarbon charge stock comprises: admixing the feed with hydrogen; reacting the admixture in a reaction zone containing desulfurization catalyst at desulfurization conditions; injecting water into the reaction zone at $H_2O/H_2$ molar ratios of about 0.05 to 0.5; separating and recycling both hydrogen and water from the reactor effluent; and recovering the substantially sulfur and nickel free product.

11 Claims, 5 Drawing Figures

SULFUR REMOVAL

NITROGEN REMOVAL

NICKEL REMOVAL

VANADIUM REMOVAL

DESULFURIZATION AND DEMETALATION OF HEAVY CHARGE STOCKS

This application is a continuation of Ser. No. 671,906, filed Mar. 29, 1976, now abandoned.

BACKGROUND OF THE INVENTION

1. Field of the Invention

The invention relates to a process for the desulfurization and demetalation of nickel and sulfur containing heavy hydrocarbon charge stocks.

2. Description of the Prior Art

Heavy hydrocarbon charge stocks, such as residual petroleum oil fractions, that is, those heavy fractions produced by atmospheric and vacuum crude distillation columns, are typically characterized as being undesirable as feed stocks for most refining processes due primarily to their high metal and sulfur content. The presence of high concentrations of metals and sulfur and compounds thereof precludes the effective use of such residua as chargestocks for cracking, hydrocracking and coking operations as well as limiting the extent to which such residua may be used as fuel oil. Perhaps the single most undesirable characteristic of such feedstocks is the high metals content. Principal metal contaminants are nickel and vanadium, with iron and small amounts of copper also sometimes present. Additionally, trace amounts of zinc and sodium are found in some feedstocks. As the great majority of these metals, when present in crude oil, are associated with very large hydrocarbon molecules, the heavier fractions produced by crude distillation contain substantially all the metal present in the crude, such metals being particularly concentrated in the asphaltene residual fraction. The metal contaminants are typically large organometallic complexes such as metal prophyrins and asphaltenes.

Processes for desulfurization of such charge stocks are known, but many of these processes are not suited to effect metal removal. In U.S. Pat. No. 3,720,602, a process for the hydrodesulfurization of substantially nonmetal containing hydrocarbon feeds is described. This process involves the use of specific vanadium-containing catalyst and injection of water into the desulfurization reactor to effect cooling and to enhance catalyst activity. Water thus injected is separated from the reactor effluent for recycle. Water injection between the catalyst beds of a multi-bed desulfurization reactor is disclosed in U.S. Pat. No. 3,753,894. In this reference, it was reported that processing petroleum residuum feeds with hydrogen plus 10 volume percent water effects a supression of the normal catalyst deactivation rate particularly during the initial period of the product run.

Other disclosures have been made concerning the use of water in desulfurization. Asphaltene-containing black oil is desulfurized by admixing the oil with between 2.0% to about 30.0%, by weight, of water, then reacting with hydrogen at desulfurization conditions over a desulfurization catalyst in U.S. Pat. No. 3,501,396. In U.S. Pat. No. 3,453,206, it is disclosed that in plural stage hydrorefining of petroleum crude oils and the heavier hydrocarbon fractions obtained therefrom, water may be used in the second or catalytic stage, when it is desired to maximize gasoline boiling range hydrocarbons in the product as distinguished from maximizing middle distillate hydrocarbons. Both U.S. Pat. Nos. 3,471,398 and 3,475,324 are related to improved hydrocarbon quench methods in the desulfurization of high boiling hydrocarbons. These patents disclose that it has been found appropriate to add water to the reaction zone in admixture with the charge stock in some instances, however, the use of water is not normally necessary or desirable.

None of the above references disclose the novel desulfurization and demetalation process of this invention.

SUMMARY OF THE INVENTION

A process for the improved desulfurization and demetalation of a nickel and sulfur containing heavy hydrocarbon charge stock has now been found. This process includes the steps:

(a) admixing said charge stock with a hydrogenrich stream;

(b) reacting the admixture of step (a) in a reaction zone containing a desulfurization catalyst at desulfurization conditions;

(c) injecting water into said reaction zone at a water to hydrogen molar ratio from about 0.05 to 0.5;

(d) separating a light gas stream which contains $H_2$, $H_2O$, $H_2S$ and light hydrocarbons from the effluent of said reaction zone;

(e) separating the $H_2O$ from the light gas stream, leaving a substantially dry light gas stream;

(f) recycling the separated $H_2O$ for injection as in step (c);

(g) separating the $H_2S$ from the dry light gas stream, leaving a hydrogen-rich stream;

(h) recycling said hydrogen-rich stream for admixing with charge stock; and (i) recovering a substantially nickel and sulfur-free product from the effluent of said reaction zone.

DESCRIPTION OF SPECIFIC EMBODIMENTS

Figure 1:
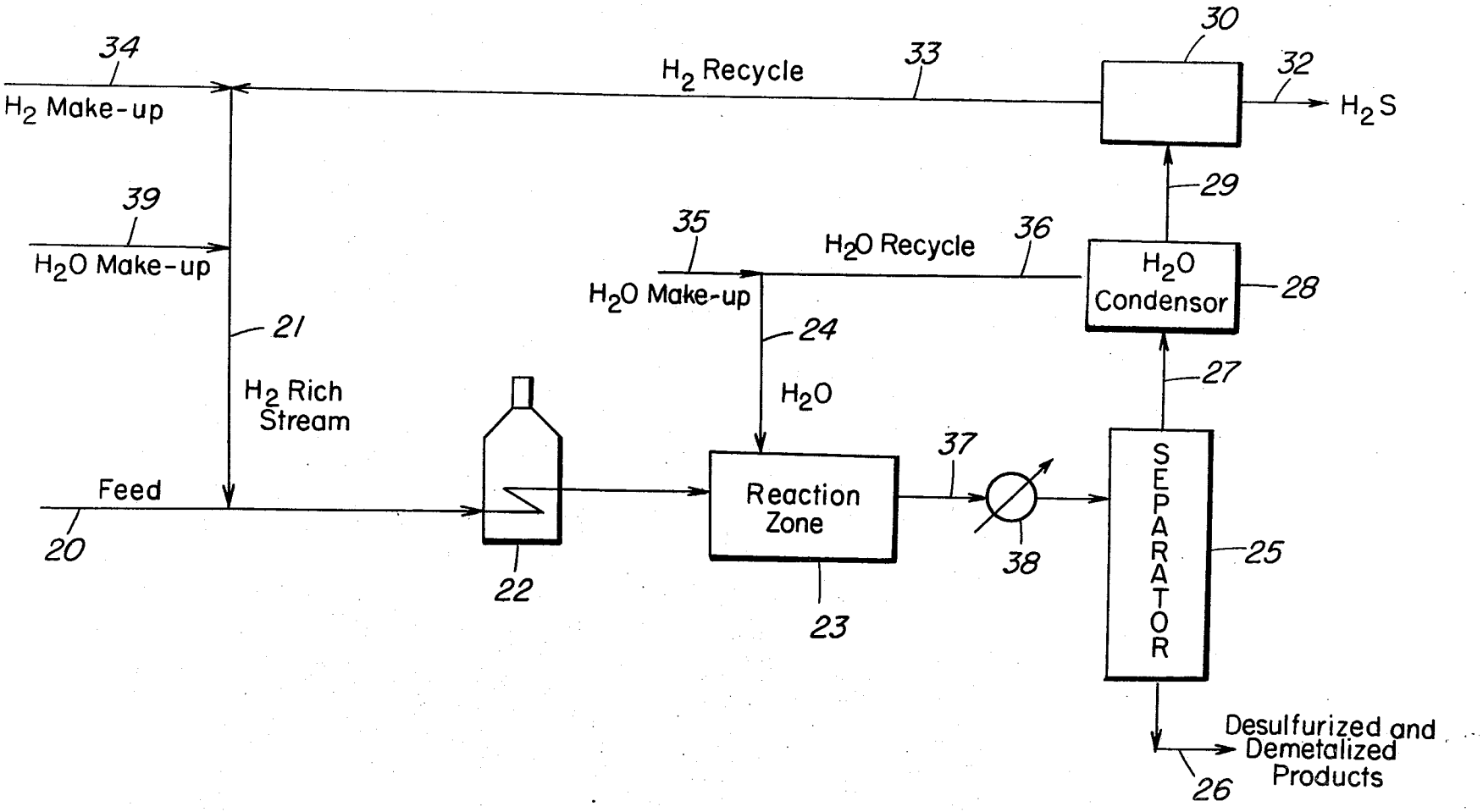
FIG. 1 is a diagrammatic representation of the process of the present invention.
Figure 2:
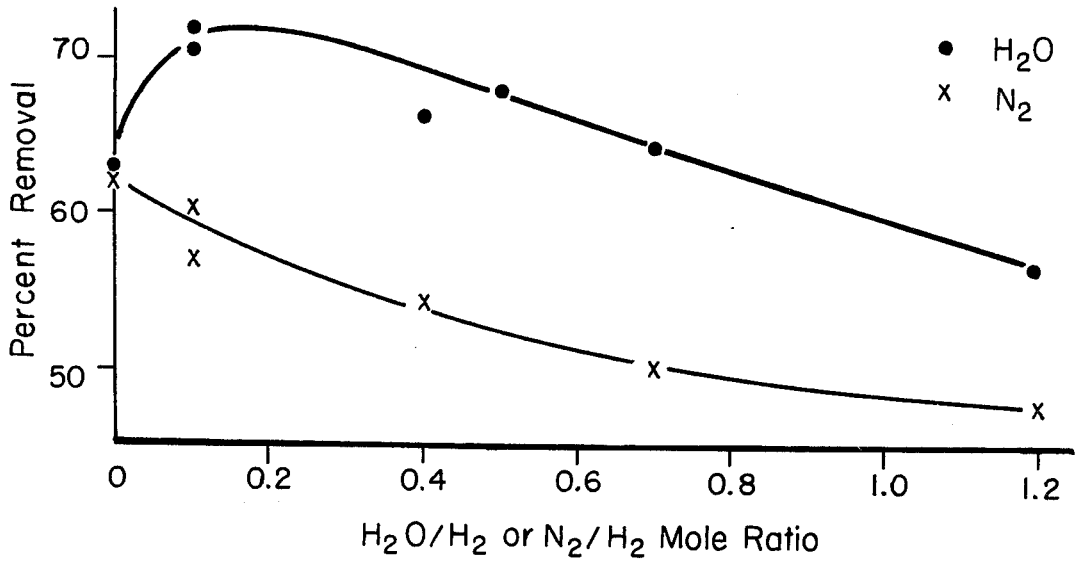
FIGS. 2, 3, 4 and 5 respectively depict percent sulfur, nitrogen, nickel and vanadium removal at various $H_2O/H_2$ and $N_2/H_2$ mole ratios.
Figure 3:
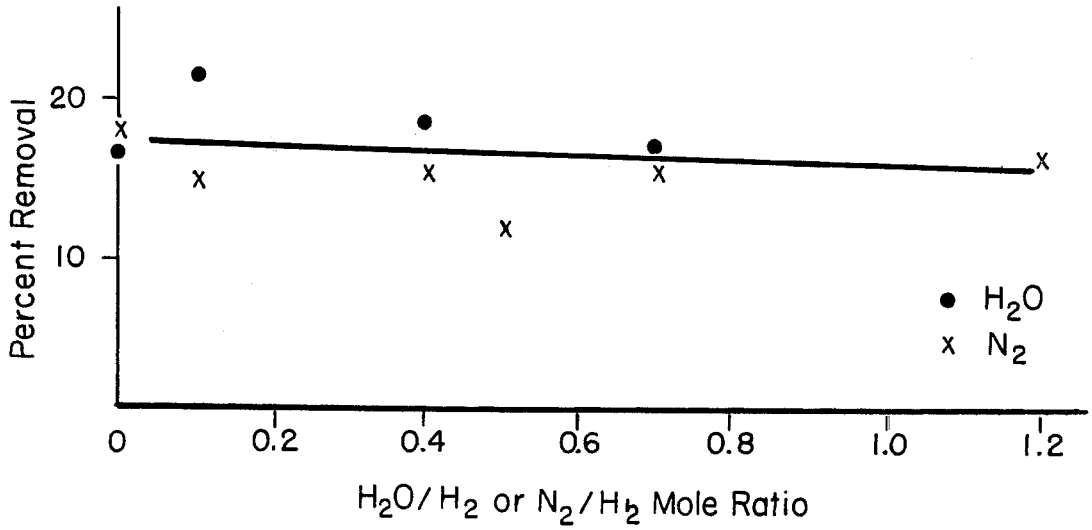
Figure 4:
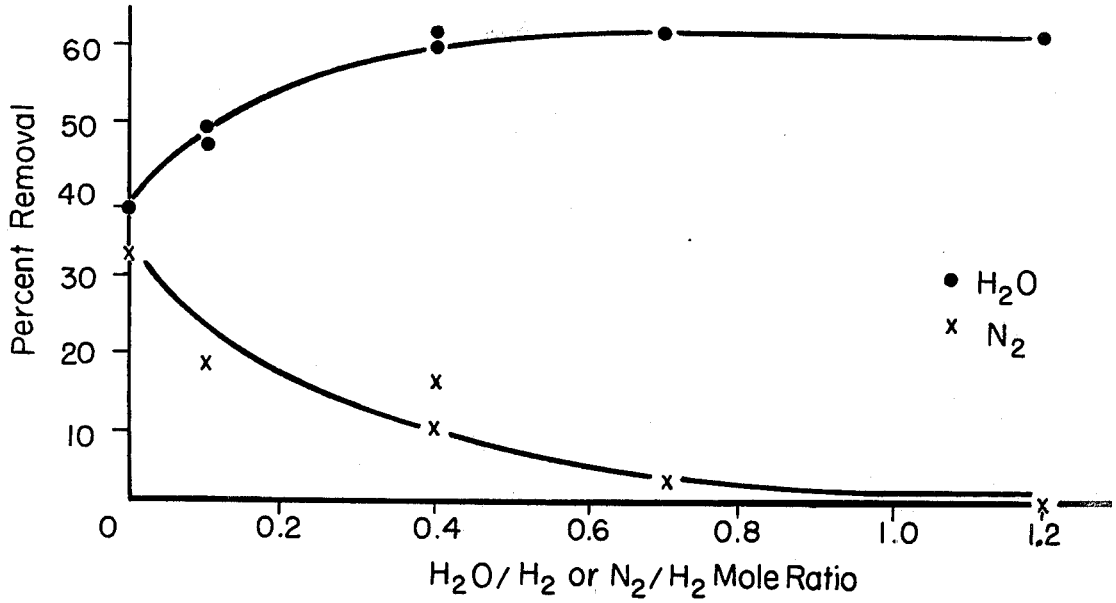
Figure 5:
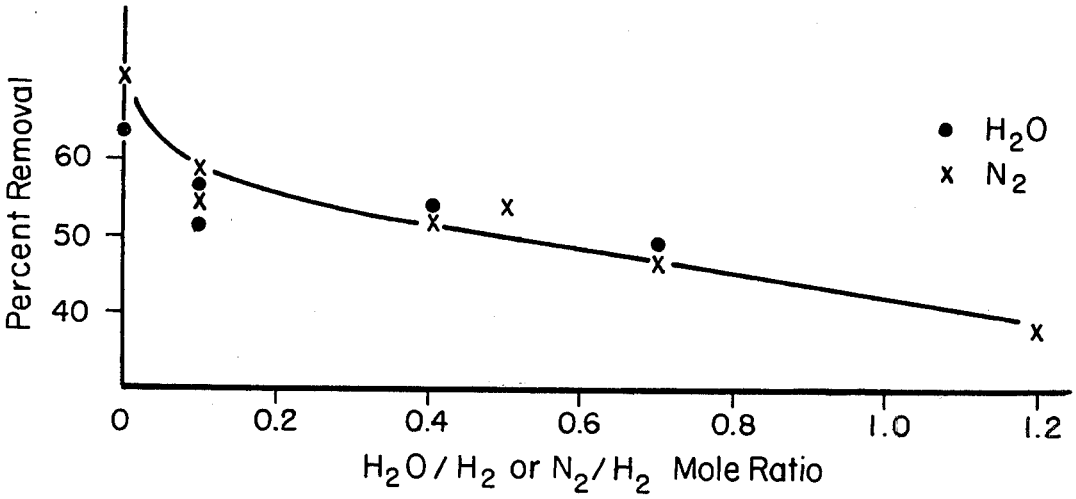

The process of the present invention is directed to improved desulfurization and demetalation of heavy hydrocarbon charge stocks which can be any metal and sulfur containing stock, preferably one containing residual fractions. Examples include stocks such as atmospheric and vacuum resids, vacuum gas oils, tar sands, bitumin, cycle stocks, shale oils and the like. From what has been said, it will be clear that the feedstock can be a whole crude. However, since the high metal and sulfur components of a crude oil tend to be concentrated in the higher boiling fractions, the present process more commonly will be applied to a bottoms fraction of a petroleum oil, i.e. one which is obtained by distillation of a crude petroleum oil to remove lower boiling materials. Accordingly, the heavy hydrocarbon charge stocks used herein generally boil above about 400° F., preferably above about 650° F., and have gravities from about 0° API to about 30° API. A general range of the properties of heavy hydrocarbon charge stocks which are suitable for use in the process of this invention as well as the properties of a particular charge stock are listed in Table 1.

TABLE 1

| | General Range | Arab Light Atmospheric Resid |
|---|---|---|
| Sulfur, Wt. % | 1-10 | 3.85 |
| Nitrogen, Wt. % | 0.1-3 | 0.22 |
| Oxygen, Wt. % | 0-10 | 0.13 |
| Total Metals, ppm | 10-3000 | 65 |
| Vanadium, ppm | 10-2000 | 49 |
| Nickel, ppm | 1-300 | 13 |

Catalyst which can be used to promote desulfurization reactions contain at least one metallic component selected from the Groups VIB and VIII of the Periodic Table deposited on a refractory inorganic oxide support or binder. The preferred metallic component may be an oxide or sulfide of nickel or cobalt, particularly the latter and an oxide or sulfide of molybdenum or tungsten. The Group VIII metal is generally present in amounts from 1-15 percent by weight, while the Group VIB component is present in amounts from 5-25 percent by weight. The refractory inorganic oxide support may comprise alumina, silica, zirconia, magnesia, titania, boria, strontia, hafnia and mixtures thereof. Particularly preferred are alumina or silica-stabilized alumina, with the alumina being of the greater proportion. A typical catalyst consists of 3 percent CoO, 10 percent $MoO_3$, 5 percent $SiO_2$ on alumina. Catalyst are generally presulfided prior to use.

Table 2 lists suitable reaction conditions for the catalytic desulfurization of heavy hydrocarbon charge stocks.

TABLE 2

| DESULFURIZATION CONDITIONS | General Range | Preferred |
|---|---|---|
| Pressure, psig | 500-3000 | 1000-2000 |
| Temperature, °C. | 250-500 | 350-450 |
| Space Velocity, LHSV | 0.2-5 | 0.5-2 |
| Hydrogen Rate, SCF/bbl | 1000-20,000 | 4000-12,000 |

The efficaciousness of the novel desulfurization and demetalation process of this invention is in part based upon the effects of water injection on the hydro-processing of heavy charge stocks. This discovery will be described in more detail hereinafter, however, briefly, it was found that injection of water into the reaction zone at certain $H_2O/H_2$ molar ratios enhances both desulfurization and nickel removal. Also, water injection in the particular specified amount was found to have no deleterious effect on nitrogen removal, catalyst aging or catalyst physical properties such as surface area. Thus, thus novel process disclosed herein provides for increased sulfur and nickel removal without relying on undesirable changes of process variables such as increasing pressure or temperature. In fact, the partial pressure of costly hydrogen in greatly reduced by the use of this invention.

A process incorporating the above discovery is now described. Referring to FIG. 1, a heavy hydrocarbon charge stock stream 20 containing sulfur, nitrogen and oxygen heteroatoms plus metals such as nickel and vanadium is mixed with a hydrogen-rich gas stream 21 and the resulting admixture is heated in furnace 22 before being charged to reaction zone 23. Reaction zone 23 contains desulfurization catalyst and may include a plurality of beds. Water from line 24, which includes both recycled water from line 36 and make up water from line 35, as needed, is injected into reaction zone 23 in amounts from about 0.05 to 0.5 $H_2O/H_2$ (molar ratios), preferably 0.05 to 0.2. If desired, a portion of the water may be injected into the reaction zone by admixture with the hydrogen rich stream, said water being introduced via line 39. Used in these amounts, the water effects increased desulfurization and demetalation of the charge stock, as will be described hereinafter, as well as cooling or quenching. Water may be injected between beds if a plurality of beds are incorporated in reaction zone 23.

The reaction zone effluent in line 37 is passed through heat exchanger 38 before it enters separator 25. Heat exchanger 38 is used to adjust the temperature of the effluent, which contains $H_2$, $H_2O$, $H_2S$, light hydrocarbons and desulfurized and demetalized products, to the conditions of separator 25, which desirably is a high pressure flash separator. The gaseous effluents from separator 25, which include $H_2$, $H_2O$, $H_2S$ and light hydrocarbons, go overhead in line 27. The desulfurized and demetalized product is withdrawn in line 26. The light gas stream of line 27 is passed into condenser 28 where water is condensed from the light gas stream, leaving a substantially dry light gas stream 29. Water, thus separated enters recycle water line 36 for injection as described hereinabove. The dry light gas stream 29 is passed to hydrogen sulfide recovery system 30 wherein hydrogen sulfide is removed by contact with a caustic scrubbing agent such as methylamine. Scrubber effluent 33, a hydrogen-rich stream consisting of hydrogen and light hydrocarbons is mixed with make up hydrogen stream 34 to form the hydrogen-rich gas stream 21 described previously.

The substantially sulfur and nickel-free products of the present invention are suited for direct use as a fuel, for example, or may be processed further. One desirable further processing use is catalytic cracking, especially fluid catalytic cracking (FCC). The products of the present invention are particularly desirable as cracking feed due to their low nickel and sulfur levels since it is known that nickel, contributes greatly to catalytic cracking catalyst poisoning.

EXAMPLE

Arab Light atmospheric resid was mixed with hydrogen. Water, which was preheated to 100° C., was added to the residhydrogen mixture at certain times throughout a run sequence. The final mixture was passed over a presulfided desulfurization catalyst containing 3% CoO, 10% $MoO_3$ and 5% $SiO_2$ on alumina in a trickle bed reactor at a pressure of 700 psig and temperatures of 750° F. and 800° F. The weight hourly space velocity was 2. A standard run sequence was used so that the reactor was lined out at the lower temperature for four days with no water, followed by a seven day series of tests with water addition, further followed by a return to the original water-free condition to monitor aging. The sequence was continued at the higher temperature. Table 3 illustrates the standard run sequence.

TABLE 3

| Standard Run Sequence | | | |
|---|---|---|---|
| Day | Temp. | $H_2O/H_2$ | Gas Circulation* SCF/bbl |
| 1-4 | 750° F. | 0 | 8500-9000 |
| 5 | " | 0.4 | 12000 |
| 6,7 | " | 0.1 | 9000-10000 |

TABLE 3-continued

| Standard Run Sequence | | | |
|---|---|---|---|
| Day | Temp. | $H_2O/H_2$ | Gas Circulation* SCF/bbl |
| 8 | " | 0.7 | 8500–9000 |
| 9 | " | 0.4 | 12000 |
| 10 | " | 0.5 | 13000 |
| 11 | " | 1.2 | 8500–9500 |
| 12,13 | " | 0 | 8500–9000 |
| 14,15 | 800 | 0 | 8500–9000 |
| 16 | " | 0.4 | 12000 |
| 17,18 | " | 0.1 | 8000–9000 |
| 19 | " | 0.7 | 8000–9000 |
| 20 | " | 0.4 | 12000 |
| 21,22 | | 0 | 8500–9000 |

*Includes $H_2O$

Reaction products were separated from the water and dried over a 4 A molecular sieve before analysis. It was determined that the water layer did not contain organic sulfur compounds, therefore, the reported effects were not artifacts of some extraction process.

In order to compare activity as a function of $H_2O/H_2$ mole ratio, a second order rate expression was assumed and conversion data were mathematically adjusted to eliminate catalyst aging. Thus, the activity for sulfur, nitrogen, nickel and vanadium removal at different $H_2O/H_2$ ratios is shown in FIGS. 2–5. Examination of the Figures shows the desulfurization activity to be markedly improved at $H_2O/H_2$ molar ratios of about 0.05 to 0.5, especially 0.05–0.2. Similarly, nickel removal is increased at $H_2O/H_2$ ratios greater than about 0.1. Nitrogen removal remains unchanged while vanadium removal falls slightly with increasing $H_2O/H_2$ ratios.

In a separate series of tests, equimolar ratios of $N_2$ were substituted for the water used in the above described series of tests to isolate the effects of water from those of diffusion and of the laboratory trickle bed reactor. The results, also plotted in FIGS. 2–4, indicate that the beneficial nickel and sulfur removing effects are due to water injection rather than reactor or diffusional effects.

Surface area data were obtained on recovered catalyst to test the possibility of increased catalyst degradation in the presence of steam. The calcined, recovered catalyst showed a surface area of 295 $m^2/g$ as compared with a value of 280 for the fresh material. Thus, no such degradation was observed in these tests.

I claim:

1. In a process for removing sulfur and nickel from a heavy hydrocarbon charge stock which contains from about 10 to about 3000 ppm total metals including nickel and from about 1 to about 10 weight percent sulfur by reaction of the charge stock with hydrogen in the presence of a desulfurization catalyst in a reactor with one or more catalyst beds including a first catalyst bed, the improvement comprising reducing the hydrogen partial pressure and enhancing sulfur and nickel removal by:

(a) mixing said charge stock and a hydrogen-rich stream optionally containing water;

(b) heating the mixture from step (a) to reaction temperature;

(c) injecting said heated mixture and water into said reactor and reacting the resulting heated admixture in said first catalyst bed, said first catalyst bed containing desulfurization catalyst which consists of at least one metallic component selected from the Groups VIB and VIII of the Periodic Table deposited on a refractory inorganic oxide support, under desulfurization conditions, wherein the water to hydrogen molar ratio in the reaction is from about 0.05 to about 0.5;

(d) separating a light gas stream which contains $H_2$, $H_2O$, $H_2S$ and light hydrocarbons from the effluent of said reaction zone;

(e) separating the $H_2O$ from said light gas stream leaving a substantially dry light gas stream;

(f) recycling the separated $H_2O$ for injection as in step (c);

(g) separating from $H_2S$ from the dry light gas stream leaving a hydrogen-rich stream;

(h) recycling said hydrogen-rich stream for admixing with said charge stock, and (i) recovering the desulfurized and demetallized product from the effluent of said reaction zone; said water injected in steps (a) and (c) being at a temperature which is not in excess of the reaction temperature in step (b).

2. The process of claim 1 wherein at least a portion of the water present in the reaction step (c) is injected with the hydrogen-rich stream.

3. The process of claim 1 wherein the conditions of step (c) comprise a pressure of about 500 to about 3000 psig and a temperature of about 250° to about 500° C.

4. The process of claim 1 wherein said catalyst comprises cobalt and molybdenum in either the oxide or sulfide form deposited on alumina.

5. The process of claim 1 wherein water is injected into said reaction zone at a water to hydrogen molar ratio from about 0.5 to about 0.2.

6. The process of claim 1 wherein separation of step (d) is effected by a high temperature flash.

7. The process of claim 1 wherein the admixture of step (a) comprises from about 1000 to about 20,000 SCF $H_2$/BBL.

8. The process of claim 1 wherein the separation of step (e) is effected by condensation.

9. The process of claim 1 wherein said sulfur free and nickel-free product is conducted to a catalytic cracking zone and catalytically cracked products are withdrawn from said zone.

10. The process of claim 1 wherein said Group VIB metallic component of the catalyst of step (c) is present in an amount from 5–25 percent by weight and said Group VIII metallic component is present in an amount from 1–15 percent by weight.

11. The process of claim 1 wherein the reaction step (c) is conducted in one or more catalyst beds in addition to said first catalyst bed.

* * * * *

UNITED STATES PATENT AND TRADEMARK OFFICE

CERTIFICATE OF CORRECTION

PATENT NO. : 4,272,357

DATED : June 9, 1981

INVENTOR(S) : Louis D. ROLLMANN

It is certified that error appears in the above-identified patent and that said Letters Patent are hereby corrected as shown below:

Column 6, Line 22: After "separating" change "from" to -- the --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*